US009976566B2

(12) United States Patent
Hildebrandt et al.

(10) Patent No.: US 9,976,566 B2
(45) Date of Patent: May 22, 2018

(54) RADIAL COMPRESSOR

(71) Applicants: André Hildebrandt, Oberhausen (DE); Thomas Ceyrowsky, Duisburg (DE)

(72) Inventors: André Hildebrandt, Oberhausen (DE); Thomas Ceyrowsky, Duisburg (DE)

(73) Assignee: MAN Diesel & Turbo SE, Augsburg (DE)

( * ) Notice: Subject to any disclaimer, the term of this patent is extended or adjusted under 35 U.S.C. 154(b) by 273 days.

(21) Appl. No.: 14/528,613

(22) Filed: Oct. 30, 2014

(65) Prior Publication Data

US 2015/0118061 A1 Apr. 30, 2015

(30) Foreign Application Priority Data

Oct. 31, 2013 (DE) ..... 10 2013 018 286

(51) Int. Cl.
*F04D 29/28* (2006.01)
*F04D 29/42* (2006.01)
(Continued)

(52) U.S. Cl.
CPC ..... *F04D 29/284* (2013.01); *F04D 17/00* (2013.01); *F04D 29/4206* (2013.01);
(Continued)

(58) Field of Classification Search
CPC ..... F04D 29/284; F04D 29/4206; F05D 2250/711; F05D 2250/712
See application file for complete search history.

(56) References Cited

U.S. PATENT DOCUMENTS 4,594,052 A * 6/1986 Niskanen ..... F04D 7/045 415/121.1
5,304,033 A * 4/1994 Tang ..... F04D 29/4213 415/206

(Continued)

FOREIGN PATENT DOCUMENTS

DE 10 2009 019 061 10/2010

OTHER PUBLICATIONS

Gulich, Jahonn. "Centrifugal Pumps" Springer: 2010.*

(Continued)

*Primary Examiner* — Ninh H Nguyen
*Assistant Examiner* — Topaz L Elliott
(74) *Attorney, Agent, or Firm* — Cozen O'Connor

(57) ABSTRACT

A radial compressor has at least one compressor stage. The compressor stage includes: an impeller having moving blades on a rotor side arranged in a flow channel of the compressor stage. The flow channel is bounded by a hub contour and a housing contour or cover disc contour. Each moving blade has a flow inlet edge and a flow outlet edge. In the region of the compressor stage on the hub contour of the flow channel, initially a curvature change from a first concave curvature into a convex curvature and following this a curvature change from the convex curvature into a second concave curvature is formed; and/or on the housing contour or cover disc contour of the flow channel, initially a curvature change from a first convex curvature into a concave curvature and following this a curvature change from the concave curvature into a second convex curvature is formed.

9 Claims, 2 Drawing Sheets

(51) Int. Cl.
*F04D 29/68* (2006.01)
*F04D 17/00* (2006.01)

(52) U.S. Cl.
CPC ..... *F04D 29/681* (2013.01); *F05D 2250/711* (2013.01); *F05D 2250/712* (2013.01)

(56) References Cited

U.S. PATENT DOCUMENTS 5,466,118 A * 11/1995 Heinrich ..... F04D 29/4213 415/208.3
7,338,251 B2 * 3/2008 Ro ..... F04D 29/162 415/173.1
7,798,777 B2 * 9/2010 Moussa ..... F04D 29/441 415/207
8,308,420 B2 * 11/2012 Yagi ..... F04D 29/30 415/1
8,801,364 B2 * 8/2014 Morris ..... F01D 3/025 415/106
2007/0077147 A1 * 4/2007 Higashimori ..... F04D 29/30 416/223 R
2010/0098532 A1 * 4/2010 Diemer ..... F04D 27/02 415/203
2011/0091323 A1 * 4/2011 Koike ..... F04D 29/284 416/175
2011/0299972 A1 * 12/2011 Morris ..... F01D 3/025 415/1
2012/0269636 A1 * 10/2012 Xu ..... F01D 5/141 416/185
2015/0118079 A1 * 4/2015 Dextraze ..... F01D 5/145 417/406
2016/0146215 A1 * 5/2016 Sgambati ..... F04D 29/2261 416/93 R

OTHER PUBLICATIONS

Brennen, Christopher, "Hydrodynamics of Pumps" Oxford University Press: 1994.*
Figures Annotated by Examiner (5 pages).*

* cited by examiner

RADIAL COMPRESSOR

BACKGROUND OF THE INVENTION

1. Field of the Invention

The present invention relates to a radial compressor.

2. Description of the Related Art

From DE 10 2009 019 061 A1 the fundamental construction of a radial compressor having multiple compressor stages is known. Each compressor stage comprises an impeller with multiple moving blades on the rotor side arranged in a flow channel of the respective compressor stage, wherein the flow channel of the respective compressor stage is bounded by a hub contour and a housing contour or cover disc contour, and wherein each moving blade has a flow inlet edge and a flow outlet edge. According to the prior art, the hub contour of the respective flow channel of each compressor stage is continuously curved concavely and the housing contour or the cover disc contour of the respective flow channel of each compressor stage continuously curved convexly.

SUMMARY OF THE INVENTION

Starting out from this, it is an object of the present invention to create a new type of radial compressor with improved efficiency. This object is solved through a radial compressor that, in the region of at least one compressor stage, initially comprises a curvature change on the hub contour of the respective flow channel from a first concave curvature into a convex curvature and following this a curvature change from the convex curvature into a second concave curvature and/or on the housing contour or cover disc contour of the respective flow channel, initially a curvature change from a first convex curvature into a concave curvature and following this a curvature change from the concave curvature into a second convex curvature.

By providing the convex curvature and the above curvature changes on the hub contour the moving blade loading can be equalized. By providing the concave curvature and the above curvature change on the housing contour or cover disc contour the moving blade loading can likewise be equalized. The equalization of the moving blade loading reduces the danger of a flow separation and can with the working range remaining the same provide an increase of the efficiency.

According to an advantageous further development, the following conditions apply on the hub contour of the respective flow channel:

$$0.05<R1-N/D2<0.60,$$

$$0.05<R3-N/D2<0.80,$$

$$0.10<R2-N/D2<5.00.$$

wherein R1−N is the first concave curvature of the respective flow channel on the hub side, wherein R3−N is the second curvature ranges of the respective flow channel on the hub side, wherein R2−N is the convex curvature of the respective flow channel on the hub side and wherein D2 is the outer diameter of the respective impeller. These design parameters of the hub contour of the respective flow channel are preferred for the equalization of the moving blade loading.

According to an advantageous further development, the following conditions apply on the housing contour or cover disc contour of the respective flow channel:

$$0.03<R1-D/D2<0.11,$$

$$0.05<R3-D/D2<0.52,$$

$$0.05<R2-D/D2<0.84.$$

wherein R1−D is the first convex curvature radius of the respective flow channel on the housing side or cover band side, wherein R3−D is the second convex curvature ranges of the respective flow channel on the housing side or cover band side, wherein R2−D is the concave curvature radius of the respective flow channel on the housing side or cover band side, and wherein D2 is the outer diameter of the respective impeller. These design parameters of the housing contour or cover disc contour of the respective impeller are preferred for the equalization of the moving blade loading.

According to a further advantageous further development, the curvature change on the hub contour of the respective flow channel from the first concave curvature into the convex curvature lies in a range between 10.0% and 60.0% of the length of the hub contour in meridional projection, wherein on the hub contour of the respective flow channel the curvature change from the convex curvature into the second concave curvature lies in a range between 15.0% and 75.0% of the length of the hub contour in meridional projection.

On the housing contour or cover disc contour of the respective flow channel the curvature change from the first convex curvature into the concave curvature lies in a range between 0.0% and 25% of the length of the housing contour or cover disc contour in meridional projection, wherein on the housing contour or cover disc contour of the respective flow channel the curvature change from the concave curvature into the second convex curvature lies in a range between 10.0% and 60.0% of the housing contour or cover disc contour in meridional projection.

This positioning of the curvature change on the hub contour and the housing contour and cover disc contour are preferred for the equalization of the moving blade loading.

According to a further advantageous further development, at least two, preferentially at least three, particularly preferably at least four, most preferably all of the following conditions apply in the region of the following compressor stage:

$$0.15<D1/D2<0.60,$$

$$0.20<D3/D2<0.94,$$

$$0.05<L1/D2<0.35,$$

$$0.01<L2/D2<0.15,$$

$$-20°<\alpha<+90°.$$

wherein D1 is the hub diameter of the respective impeller, D3 the suction mouth diameter of the respective impeller, D2 the outer diameter of the respective impeller, L1 the axial length of the housing contour or cover disc contour of the respective flow channel, L the axial length of the flow outlet edge of the moving blades of the respective impeller and α the angle of inclination of the flow inlet edge of the moving blades of the respective impeller. These design parameters of the respective compressor stage are preferred for the equalization of the moving blade loading.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are obtained from the following description. Exemplary embodiments of the invention are explained in more detail with the help of the drawing without being restricted to this. In the drawings.

DETAILED DESCRIPTION OF THE PRESENTLY PREFERRED EMBODIMENTS

Figure 1:
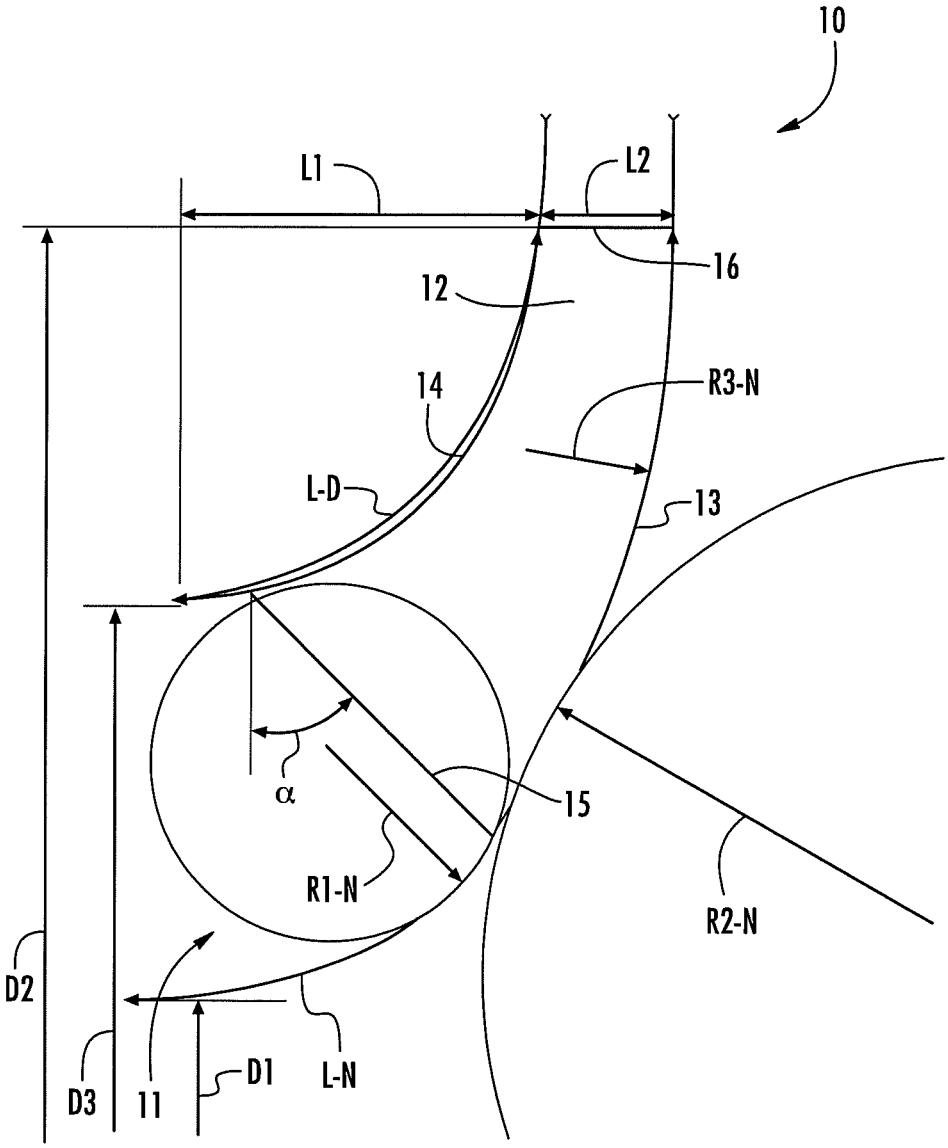
FIG. 1: is a detail of a radial compressor according to the invention in meridional section for explaining design parameters of the radial compressor.
Figure 2:
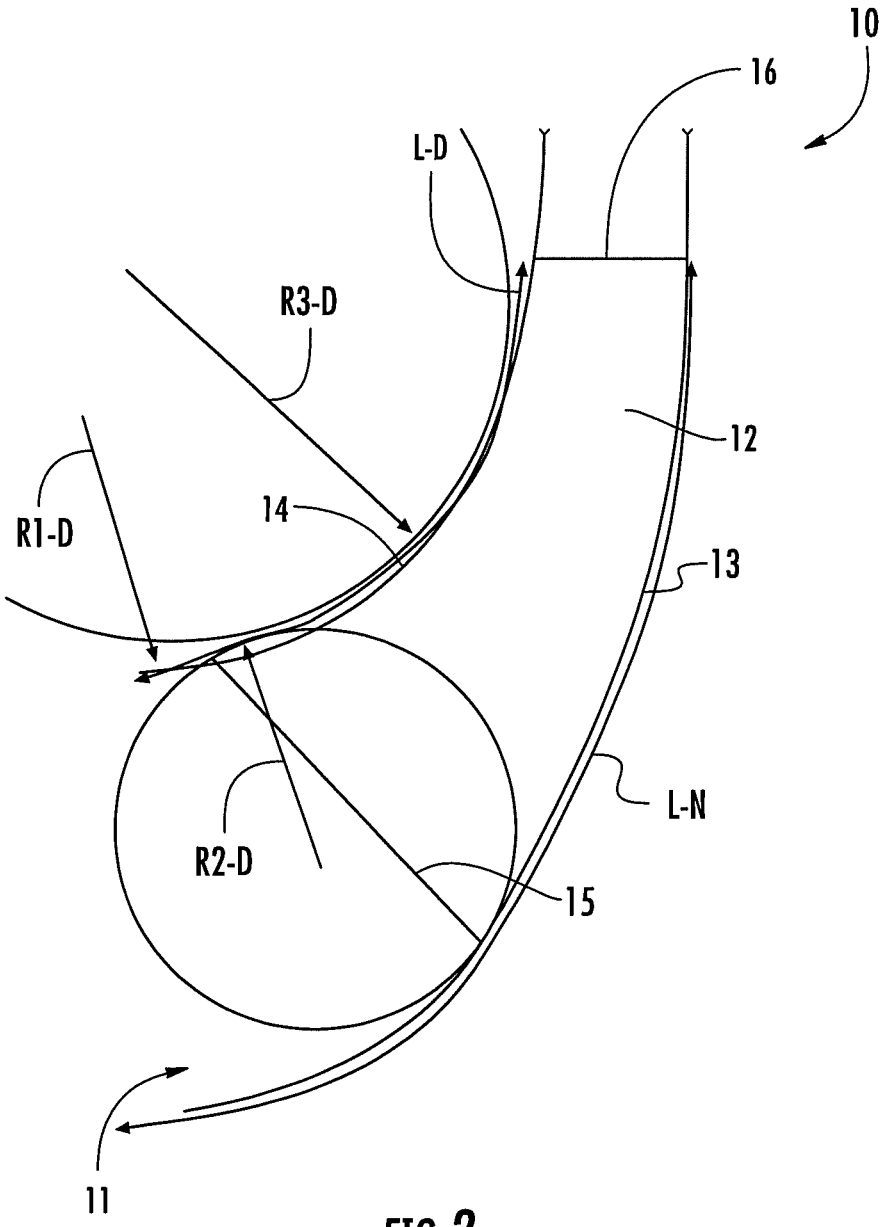
FIG. 2: is a detail for explaining further design parameters of the radial compressor.

The present invention relates to a radial compressor with at least one compressor stage. FIGS. 1 and 2 show a detail of a radial compressor according to an exemplary embodiment of the invention in the region of a compressor stage in meridional section. The, or each, compressor stage of the radial compressor according to the invention comprises an impeller 10 with multiple moving blades 12 on the rotor side arranged in a flow channel 11 of the respective compressor stage. The flow channel 11 of the respective compressor stage is bounded by a hub contour 13 on the rotor side and a housing contour 14 on the stator side or a cover disc contour 14 on the rotor side. Each moving blade 12 has a flow inlet edge 15 and a flow outlet edge 16.

In FIGS. 1 and 2, various design parameters of the compressor stage shown there are entered, namely the hub diameter D1 of the respective impeller 10, the suction mouth diameter D2 of the respective impeller 10, the outer diameter D2 of the respective impeller 10, the axial length L1 of the housing contour or cover disc contour 14 of the respective flow channel 11, the axial length L2 of the flow outlet edge 16 of the moving blades of the respective impeller 10 and the angle of inclination a of the flow inlet edge 15 of the moving blades 12 of the respective impeller 10 to the radial direction of the same.

Furthermore, a first concave curvature R1–N, a convex curvature radius R2–N and a second concave curvature radius R3–N of the hub contour 13 of the respective flow channel 11 are entered in FIG. 1 as design parameters of the compressor stage shown there.

In FIG. 2, a first convex curvature radius R1–D, a concave curvature radius R2–D and a second convex curvature radius R3–D of the housing contour or cover disc contour 14 of the respective flow channel 11 are additionally entered.

In the disclosed embodiments of the invention, initially a curvature change from a first concave curvature into a convex curvature, and following this a curvature change from the convex curvature into a second concave curvature, is formed in the region of at least one compressor stage on the hub contour 13 of the respective flow channel 11 on the rotor side seen in a through-flow direction of the respective flow channel 11. Alternatively or preferentially in addition, initially a curvature change from a first convex curvature into a concave curvature, and following this a curvature change from the concave curvature into a second convex curvature, is formed on the housing contour or cover disc contour 14 of the respective flow channel 11 seen in through-flow direction of the respective flow channel 11. Through the above curvature changes on the hub contour 13 and/or on the housing contour or cover disc contour 14 the moving blade loading of the respective impeller 10 can be equalized. The equalization of the moving blade loading on the respective impeller reduces the risk of a flow separation and can with the working range remaining the same provide an increase of the efficiency.

On the hub contour 13 of the respective flow channel 11 the curvature change from the first concave curvature into the convex curvature lies in a range between 10.0% and 60.0% of the length L–N of the hub contour in meridional projection, wherein on the hub contour 13 of the respective flow channel 11 the curvature change from the convex curvature into the second concave curvature lies in a range between 15.0% and 75.0% of the length L–N of the hub contour in meridional projection.

0% of the length L–N of the hub contour 13 in meridional projection lies upstream of the flow inlet edge 15 of the moving blades 12 and 100% of the length L–N of the hub contour 13 in meridional projection lies in the region of the flow outlet edge 16 of the moving blades 12 of the respective impeller.

Preferably, the curvature change from the first concave curvature into the convex curvature lies in a range between 16.0% and 46.0% of the length of the hub contour 13 in meridional projection and the curvature change from the convex curvature into the second concave curvature in a range between 30.0% and 65.0% of the length of the hub contour in meridional projection. These design parameters are preferred in particular when the respective flow channel 11 is bounded by a hub contour 13 on the rotor side and a cover disc contour 14 on the rotor side, i.e., in the case of so-called closed radial compressors.

On the housing contour or cover disc contour 14 of the respective flow channel 11 the curvature change from the first convex curvature into the concave curvature lies in a range between 0.0% and 25.0% of the length L–D of the housing contour or cover disc contour 14 in meridional projection, wherein on the housing contour or cover disc contour 14 of the respective flow channel 11 the curvature change from the concave curvature into the second convex curvature lies in a range between 10.0% and 60.0% of the length L–D of the housing contour or cover disc contour 14 in meridional projection.

0% of the length L–D of the housing contour or cover disc contour 14 in meridional projection lies upstream of the flow inlet edge 15 of the moving blades 12 and 100% of the length L–D of the housing contour or cover disc contour 14 in meridional projection lies in the region of the flow outlet edge 16 of the moving blades 12 of the respective impeller.

Preferably, the curvature change from the first convex curvature into the concave curvature lies in a range between 5.0% and 9.0% of the length of the housing contour or cover disc contour 14 in meridional projection and the curvature change from the concave curvature into the second convex curvature in a range between 21.0% and 35.0% of the length of the housing contour or cover disc contour in meridional projection. These design parameters are preferred with so-called closed radial compressors.

On the hub contour 13 of the respective flow channel 11 of the respective impeller 10 on the rotor side the following applies:

$$0.05<R1-N/D2<0.60,$$

$$0.05<R3-N/D2<0.80,$$

$$0.10<R2-N/D2<5.00.$$

Preferably, in the case of so-called closed radial compressors the following applies on the hub contour 13 of the respective flow channel 11 of the respective impeller 10 on the rotor side:

$$0.08<R1-N/D2<0.53,$$

$$0.15<R3-N/D2<0.39,$$

$$0.75<R2-N/D2<3.35.$$

On the housing contour 14 or cover disc contour of the respective flow channel 11 of the respective impeller 10 on the stator side the following applies:

$$0.03<R1-D/D2<0.11,$$

$$0.05<R3-D/D2<0.52,$$

$$0.05<R2-D/D2<0.84$$

Preferably, in the case of so-called closed radial compressors, the following applies on the housing contour 14 or cover disc contour of the respective flow channel 11 of the respective impeller 10 on the stator side:

$$0.06<R1-D/D2<0.09,$$

$$0.15<R3-D/D2<0.25,$$

$$0.34<R2-D/D2<0.56.$$

In the region of the respective compressor stage, at least two, preferentially at least three, particularly preferably at least four, most preferably all of the following relationships apply:

$$0.15<D1/D2<0.60,$$

$$0.20<D3/D2<0.94,$$

$$0.05<L1/D2<0.35,$$

$$0.01<L2/D2<0.15,$$

$$-20°<\alpha<+90°.$$

Preferably, in the case of so-called close radial compressors, at least two, preferentially at least three, particularly preferably at least four, most preferably all of the following relationships apply in the region of the respective compressor stage:

$$0.23<D1/D2<0.50,$$

$$0.47<D3/D2<0.94,$$

$$0.11<L1/D2<0.23,$$

$$0.04<L2/D2<0.09,$$

$$0°<\alpha<+70°.$$

The outer diameter D2 of the impeller 10 of the respective compressor stage amounts to between 30 mm and 2,500 mm.

By providing the convex curvature and the above curvature change on the hub contour 13 and/or by providing the concave curvature and the above curvature change on the housing contour or cover disc contour 14 the moving blade loading can be equalized. The equalization of the moving blade loading reduces the danger of a flow separation and can with the working range remaining the same provide an increase of the efficiency.

On the hub contour 13, the convex curvature subject to reducing the flow cross section of the flow channel 11 is curved towards the inside into the flow channel 11. On the housing contour or cover disc contour 14, the concave curvature subject to increasing the flow cross section of the flow channel 11 is curved towards the outside out of the flow channel 11.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A radial compressor, with at least one compressor stage, wherein the, or each, compressor stage comprises:

an impeller (10) having multiple moving blades (12) on a rotor side, which are arranged in a flow channel (11) of the at least one compressor stage, wherein:

the flow channel (11) of the at least one compressor stage is bounded by a hub contour (13) and a housing contour or cover disc contour (14), each moving blade (12) has a flow inlet edge (15) and a flow outlet edge (16), in the region of the at least one compressor stage on the hub contour (13) of the flow channel (11), seen in a through-flow direction of the flow channel (11) initially there is arranged a curvature change from a first concave curvature into a convex curvature that is curved towards the inside into the flow channel (11) and reduces the flow cross section of the flow channel (11) and following this there is arranged a curvature change from the convex curvature into a second concave curvature; and on the housing contour or cover disc contour (14) of the flow channel (11), seen in the through-flow direction of the flow channel (11) initially there is arranged only one curvature change from a first convex curvature into a concave curvature that is curved towards the outside out of the flow channel (11) and increases the flow cross section of the flow channel (11) and following this there is arranged only one curvature change from the concave curvature into a second convex curvature, wherein 0% of a length L–N of the hub contour (13) in meridional projection lies upstream of the flow inlet edge (15) of the moving blades (12) and 100% of a length L–N of the hub contour (13) in meridional projection lies in a region of the flow outlet edge (16) of the moving blades (12) of the impeller wherein each curvature change is a smooth transition, and wherein the housing contour or cover disk contour (14) changes in curvature are annular features.

2. The radial compressor according to claim 1, wherein on the hub contour (13) of the flow channel (11) for a first concave curvature radius R1–N and a second concave curvature radius R3–N of the flow channel (11) the following relationship with an outer diameter D2 of the impeller (10) applies in each case:

$$0.05<R1-N/D2<0.60,$$

$$0.05<R3-N/D2<0.80.$$

3. The radial compressor according to claim 2, wherein on the hub contour (13) of the flow channel (11) for a convex curvature radius R2–N of the flow channel (11) the following relationship with the outer diameter D2 of the impeller (10) applies:

$$0.10<R2-N/D2<5.00.$$

4. The radial compressor according to claim 3, wherein on the hub contour (13) of the flow channel (11) the curvature change from the first concave curvature into the convex curvature lies in a range between 10.0% and 60.0% of the length of the hub contour (13) in meridional projection, and on the hub contour (13) of the flow channel (11) the curvature change from the convex curvature into the second concave curvature lies in a range between 15.0% and 75.0% of the length of the hub contour (13) in meridional projection.

5. A radial compressor, with at least one compressor stage, wherein the, or each, compressor stage comprises:

an impeller (10) having multiple moving blades (12) on a rotor side, which are arranged in a flow channel (11) of the at least one compressor stage, wherein:

the flow channel (11) of the at least one compressor stage is bounded by a hub contour (13) and a housing contour or cover disc contour (14), each moving blade (12) has a flow inlet edge (15) and a flow outlet edge (16), in the region of the at least one compressor stage on the hub contour (13) of the flow channel (11), seen in a through-flow direction of the flow channel (11) initially there is arranged a curvature change from a first concave curvature into a convex curvature that is curved towards the inside into the flow channel (11) and reduces the flow cross section of the flow channel (11) and following this there is arranged a curvature change from the convex curvature into a second concave curvature; and on the housing contour or cover disc contour (14) of the flow channel (11), seen in the through-flow direction of the flow channel (11) initially there is arranged only one curvature change from a first convex curvature into a concave curvature that is curved towards the outside out of the flow channel (11) and increases the flow cross section of the flow channel (11) and following this there is arranged only one curvature change from the concave curvature into a second convex curvature, wherein on the hub contour (13) of the flow channel (11) for a first concave curvature radius R1–N and a second concave curvature radius R3–N of the flow channel (11) the following relationship with an outer diameter D2 of the impeller (10) applies in each case:

$$0.05<R1-N/D2<0.60,$$

$$0.05<R3-N/D2<0.80,$$

wherein on the hub contour (13) of the flow channel (11) for a convex curvature radius R2–N of the flow channel (11) the following relationship with the outer diameter D2 of the impeller (10) applies:

$$0.10<R2-N/D2<5.00,$$

wherein on the hub contour (13) of the flow channel (11) the curvature change from the first concave curvature into the convex curvature lies in a range between 10.0% and 60.0% of the length of the hub contour (13) in meridional projection, and on the hub contour (13) of the flow channel (11) the curvature change from the convex curvature into the second concave curvature lies in a range between 15.0% and 75.0% of the length of the hub contour (13) in meridional projection, and wherein on the housing contour or cover disc contour (14) of the flow channel (11) for a first convex curvature radius R1–D and a second convex curvature radius R3–D of the flow channel (11) the following relationship with the outer diameter D2 of the impeller (10) applies in each case:

$$0.03<R1-D/D2<0.11,$$

$$0.05<R3-D/D2<0.52.$$

6. The radial compressor according to claim 5, wherein on the housing contour or cover disc contour (14) of the flow channel (11) for a concave curvature radius R2–D of the flow channel (11) the following relationship with the outer diameter D2 of the impeller (10) applies:

$$0.05<R2-D/D2<0.84.$$

7. The radial compressor according to claim 6, wherein on the housing contour or cover disc contour (14) of the flow channel (11) the curvature change from the first convex curvature into the concave curvature lies in a range between 0.0% and 25% of the length of the housing contour or cover disc contour (14) in meridional projection, and on the housing contour or cover disc contour (14) of the flow channel (11) the curvature change from the concave curvature into the second convex curvature lies in a range between 10.0% and 60.0% of the length of the housing contour or cover disc contour (14) in meridional projection.

8. The radial compressor according to claim 7, wherein in the region of the respective compressor stage at least two of the following relationships apply:

$$0.15<D1/D2<0.60,$$

$$0.20<D3/D2<0.94,$$

$$0.05<L1/D2<0.35,$$

$$0.01<L2/D2<0.15,$$

$$-20°<\alpha<+90°,$$

wherein D1 is a hub diameter of the impeller (10), D3 is a suction mouth diameter of the impeller (10), D2 is the outer diameter of the impeller (10), L1 is an axial length of the housing contour (14) or cover disc contour of the flow channel (11) on the stator side, L2 is an axial length of the flow outlet edge (16) of the moving blades (12) of the impeller (10) and a is an angle of inclination of the flow inlet edge (15) of the moving blades (12) of the impeller (10).

9. The radial compressor according to claim 8, wherein the outer diameter D2 of the impeller (10) of the at least one compressor stage is between 30 mm and 2,500 mm.

* * * * *